United States Patent [19]

Borchert

[11] 4,101,691

[45] Jul. 18, 1978

[54] ENHANCED HEAT TRANSFER DEVICE MANUFACTURE

[75] Inventor: Robert Curtis Borchert, West Seneca, N.Y.

[73] Assignee: Union Carbide Corporation, New York, N.Y.

[21] Appl. No.: 721,865

[22] Filed: Sep. 9, 1976

[51] Int. Cl.[2] ..... B05D 3/02

[52] U.S. Cl. ..... 427/229; 165/1; 165/133; 427/191; 427/192; 427/205; 427/376 E

[58] Field of Search ..... 427/376 B, 376 C, 376 H, 427/376 D, 376 E, 376 G, 405, 180, 181, 190, 191, 192, 205, 239, 245, 287, 271, 383 C, 229; 29/192 R, 194, 196, 197, 199; 165/1, 133

[56] References Cited

U.S. PATENT DOCUMENTS

| | | | |
|---|---|---|---|
| 1,197,695 | 9/1916 | Watkins | 427/376 |
| 2,908,072 | 10/1959 | Johnson | 427/376 |
| 2,997,783 | 8/1961 | Crehan et al. | 427/376 |
| 3,185,334 | 5/1965 | Omilina | 220/9 |
| 3,199,714 | 8/1965 | Bodendorf et al. | 220/9 |
| 3,310,870 | 3/1967 | Parikh et al. | 427/383 |
| 3,316,625 | 5/1967 | Flint et al. | 427/383 |
| 3,384,154 | 5/1968 | Milton | 165/1 |
| 3,523,577 | 8/1970 | Milton | 165/133 |
| 3,587,730 | 6/1971 | Milton | 165/133 |
| 3,666,006 | 5/1972 | Valyi | 165/133 |
| 3,753,757 | 8/1973 | Rodgers et al. | 427/191 |
| 3,821,018 | 6/1974 | Grant | 29/192 |
| 3,832,168 | 8/1974 | Gulla | 29/194 |
| 3,876,447 | 4/1975 | Lally | 427/190 |
| 3,990,862 | 11/1976 | Dahl et al. | 165/133 |

*Primary Examiner*—Ronald H. Smith
*Assistant Examiner*—Sadie L. Childs
*Attorney, Agent, or Firm*—John C. LeFever

[57] ABSTRACT

An adherent mass of base metal powder-first liquid binder is first formed, then braze metal powder mixed therewith to form braze metal-coated mass, the latter being applied on a second liquid binder coated substrate and heated.

13 Claims, 1 Drawing Figure

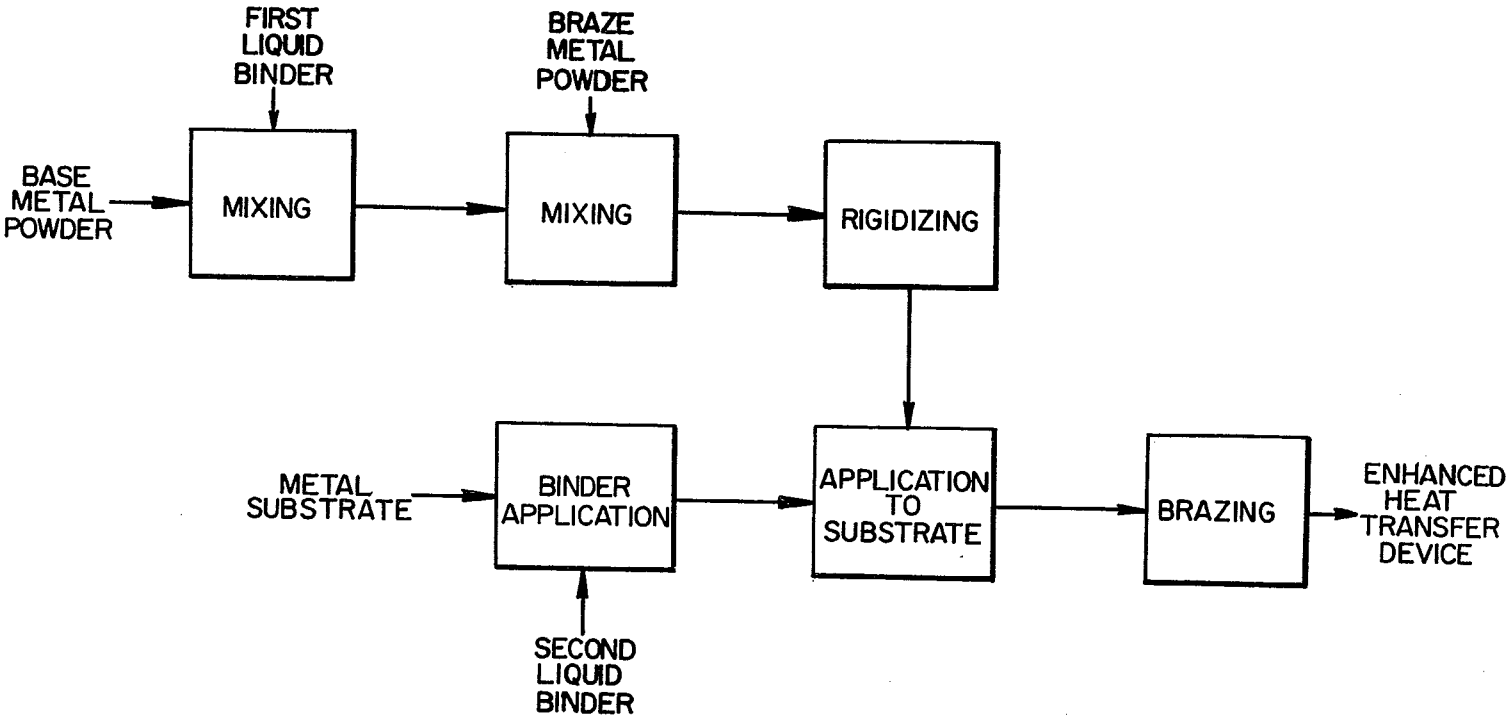
BASE METAL POWDER
FIRST LIQUID BINDER
MIXING
BRAZE METAL POWDER
MIXING
RIGIDIZING
METAL SUBSTRATE
BINDER APPLICATION
SECOND LIQUID BINDER
APPLICATION TO SUBSTRATE
BRAZING
ENHANCED HEAT TRANSFER DEVICE

ENHANCED HEAT TRANSFER DEVICE MANUFACTURE

BACKGROUND

This invention relates to a method for manufacturing an enhanced heat transfer device consisting of a metal substrate and randomly distributed metal bodies bonded to the substrate.

One type of enchanced heat transferdevice of the metal bonded variety is described in Milton U.S. Pat. No. 3,384,154, in which the metal particles are stacked and integrally bonded together and to a metal substrate to form inter-connected pores of capillary size. This is a multiple layer surface used to enhance the boiling heat transfer coefficients for fluids of either low surface tension or high surface tension. For use with relatively high surface tension fluids or for boiling at subambient pressure, the Milton-type porours boiling surface should have a relatively large effective pore radius and to form same the base metal powder must be composed of relatively large particles. The preferred method for fabricating the Milton surface is by blending a base metal powder component which ultimately forms the porous matrix of the structure and a lower melting brazing component powder. The dry mixture of the two components is simultaneously applied to a binder coated substrate and subsequently heated to a temperature and for a time sufficient to metal bond the matrix or base metal powder to the substrate.

The foregoing technique requires the use of a brazing component whose particle size is quite small relative to the base metal particles. Small braze metal particles are required in order to avoid excessively high localized concentrations of low melting alloy. Excessive local concentrations of this component result in the solution of an undesirable quantity of base metal component or substrate into the local molten brazing alloy. This in turn may result in collapse of the base metal matrix component causing serious detrimental alteration of the effective pore radius. In addition, the substrate may be weakened or penetrated by solution of an undesirable amount of substrate metal into the molten alloy at locations of high concentrations of braze metal component. Finally, the above described technique for producing the molten surface employing a dry mixture of powders having widely different particle sizes presents a severe problem of maintaining a uniform mixture during the steps involved in applying the mixed powder to the substrate surface. The tendency for the base metal and braze metal components to segregate during normal handling and application of the mixture results in improper distribution of the base metal or matrix component, inadequate bonding between individual particles and with the substrate surface, and in the above described metallurgical problems associated with high localized concentrations of braze metal component.

Another type of enhanced heat transfer device with metal bodies bonded to a metal substrate is described and claimed in a patent application Ser. No. 721,862 entitled "Enhanced Condensation Heat Transfer Device and Method" filed on even date herewith in the name of Frank Notaro. The Notaro-type metal body surface comprises a single layer of randomly distributed metal bodies each individually bonded to the substrate, spaced from each other and substantially surrounded by said substrate. This device is useful, for example, in the enhancement of condensation heat transfer and may be formed from base metal powder which passes through a 30 mesh size U.S. Standard Screen and is retained on a 40 U.S. Standard Screen. The fabrication of this type surface presents problems similar to those enumerated above for the Milton-type surface. Again, a wide disparity in particle sizes is encountered between the base metal powder and the braze metal powder.

An object of this invention is to provide a method for manufacturing an enhanced heat transfer device consisting of a metal substrate and randomly distributed metal bodies bonded to the substrate, employing a braze metal powder of major dimensions substantially smaller than the base metal powder, without reducing the base metal major dimensions.

Another object is such a manufacturing method which does not weaken the substrate metal by excessive solution into the molten alloy.

Still another object is such a manufacturing method which maintains a uniform mixture of base metalbraze metal powder during the steps of applying the mixture to the metal substrate.

Other objects and advantages of this invention will be apparent from the ensuing disclosure and appended claim.

SUMMARY

This invention relates to a method for manufacturing an enhanced heat transfer device consisting of a metal substrate and randomly distributed metal bodies bonded to the substrate.

In this method base metal powder with particles of major dimensions less than 0.1 inch is provided and mixed with first liquid binder in proportion such that the weight ratio of base metal powder to first liquid binder is between 20:1 and 30:1, so as to form an adherent mass. Braze metal powder having a melting point lower than the base metal powder is also provided having particles of major dimensions such that the major dimension ratio of braze metal powder to base metal powder is between 1:60 and 1:3. The braze metal powder and the aforedescribed adherent mass are mixed in weight proportion such that the braze metal powder is between 10 and 30 percent of the braze metal powder plus the base metal powder, so as to form braze metal-coated mass. A second liquid binder is applied on the metal substrate and the aforedescribed braze metal-coated mass is then applied on the second liquid binder coated metal substrate. The so-formed braze metal coated mass-metal substrate is heated sufficiently to remove the first and second binders, melt the braze metal and metal bond the base metal to the metal substrate thereby forming the metal bodies.

The base metal powder constitutes the bulk structure of the final metal bodies and the powder is preliminarily sized to provide the desired major or greatest dimension of the individual particles. The major dimension of the base metal powder particles should not exceed 0.10 inch and preferably should be within the range of 0.006 to 0.060 inch. Particle dimensions for these purposes correspond generally to the opening size of U.S. Standard series screen through which the particles will pass.

The adherent mass comprises base metal powder particles individually covered with a thin layer of first liquid binder. The first liquid binder may be a single component material, but preferably is a plural component material. A required component is a low volatility organic compound capable of wetting the base metal particles and capable of being removed from the base metal particles by vaporization and/or chemical decomposition without leaving an undesirable residue on the metal surfaces. A preferred low volatility organic compound is an isobutylene polymer having a molecular weight of at least about 90,000. A higher volatility compound which is a solvent for the low volatile organic compound may be included as another component of the first liquid binder. A preferred higher volatility compound is kerosene.

The braze metal-coated mass is produced by admixture of the braze metal powder with the adherent mass thereby obtaining a relatively dry flowable powderlike material. The braze metal powder is a metal or alloy material having a melting point lower than the base metal powder and capable of forming a metallic bond therewith and with the substrate. Its particles size is substantially smaller than that of the base metal powder, such particle size being defined as the major dimension of the particles. Preferably, the major dimension ratio of braze metal powder to base metal powder is between 1:30 and 1:3.

"Partially rigidizing" is a procedure for stiffening or setting the first liquid binder after formation of the braze metal-coated mass. The braze metal particles are thereby firmly attached to the base metal particles. A preferred method of partially rigidizing is by heating the braze metal-coated mass at temperatures of 150°-200° F in order to vaporize higher volatility component from the first liquid binder.

The single figure is a block diagram showing the several steps of the manufacturing method of this invention.

DETAILED DESCRIPTION

The single drawing is a block diagram showing the several steps employed to produce the enhanced heat transfer devices in accordance with the method of the invention. With reference to the drawing, a base metal powder is provided having the desired particle dimension. Various regular or irregular shapes of particles are suitable, for example, shapes which generally approximate spheres, cubes, short cylindrical rods, rhombuses, or pyramids. A common desirable characteristic is that the shapes are compact, having a minor, i.e., smallest dimension which is not greatly different than at least one other dimension. Thus, in the case of a short cylindrical rod whose length is greater than the diameter, the length is the major dimension. For a rhombus of length L, width W, and height H, where $H < W < L$, the length L is the greatest dimension, the height H is the minor dimension and the height H should not be greatly different than the width W.

The major dimension of the base metal powder particles should not exceed 0.10 inch and preferably should be within the range of 0.006 to 0.060 inch. Particles outside these ranges can be removed or excludes by screening commercial grade powder through a selected series of Standard U.S. screens. Alternatively, and particularly for relatively large base metal powder particles, the particles may be produced in uniform dimension by cutting short lengths of wire of desired diameter. The above major dimensions are largely established by the performance characteristics of the resultant metal bodies when applied and utilized in enhanced heat transfer structures. In addition, base metal particles of sizes smaller than 0.006 inch can usually be maintained in uniform, dry admixture with fine braze metal powder without adverse segregation.

By way of illustration, suitable materials for the base metal powder include copper, copper-nickel alloy (e.g., 70-95 percent copper), iron, stainless steel (e.g., Type 304 or 316) and aluminum.

A first liquid binder is also provided for admixture with the base metal powder in a first mixing step. The first liquid binder may be a single component material but preferably is a plural component material. A required component is a low volatility organic compound which is, or can be made sufficiently fluid to spread across and wet the surface of the base metal particles. It should preferably be partially rigidizable as hereinafter defined so as to hold the braze metal particles securely attached to the base metal particles. Finally, the low-volatile organic component must be removable from the base metal particles as by vaporization and/or chemical decomposition without leaving an undesirable residue on the metal surfaces. Suitable types of low volatility organic components are high molecular weight polymers, and lower molecular weight compounds capable of thermally or catalytically polymerizing or cross-linking to form higher molecular weight compounds. A preferred low volatility organic compound is an isobutylene polymer having a molecular weight of at least about 90,000 such as commercially available "Vistanex" (trade name of Enjay Chemical Company). A higher volatiltiy compound which is a solvent for the low volatile organic compound may be included as another component of the first liquid binder. Examples of higher volatility compounds are mineral spirits, toluene, benzene and water. A preferred higher volatility compound is kerosene.

Admixture of the first liquid binder and the base metal powder produces an adherent mass which comprises base metal powder particles individually covered with a thin layer of adherent first liquid binder. The quantity and consistency of the binder mixed with the base metal powder is such that the binder is held intact on the particle surfaces and does not drain off. The consistency of the adherent mass may be described as semi-mobile and highly viscous but not "gummy".

A braze metal powder is provided also of predetermined major particle dimension. The braze metal powder is a metal or alloy material having a melting point lower than the base metal powder and capable of forming a strong metallic bond therewith and with the substrate. The major dimension of the braze metal powder particles is such that the major dimension ratio of the braze metal powder to base metal powder is between 1:60 and 1:3 and preferably is within the range of 1:30 and 1:3. For many uses of the invention, the braze metal powder can be prepared from commercially available powders by rejecting particles which do not pass a 325-mesh U.S. Standard screen.

The higher major dimension ratio of 1:3 reflects limits of the ability of first liquid binder to hold the braze metal particles securely attached to the base metal particles. In addition, a higher ratio means closer correspondence in the dimensions of the two components, and it is evident that for complete correspondence, i.e., a ratio of 1:1, a pairing of one particle of base metal and one particle of braze metal, would produce a localized excessive content of braze metal equal to 50 percent of the combined base metal plus braze metal. Finally, higher dimension ratios typify powder mixtures capable of maintaining uniform composition in the dry state without segregation.

At the other extremen, major dimension ratios lower than 1:60 tend to result in inadequate braze metal content of the braze metal-coated mass. This inadequacy is related to the low surface area of large base metal particles relative to their volume or mass. Insufficient numbers of tiny braze metal particles will become attached to the limited surface area of the base metal and the desired percentage of braze metal will not be obtained. In preferred practice, major dimension ratios larger than 1:30 are employed to insure that adequate braze metal will be bonded to individual particles of base metal.

For the preparation of single layer, Notarotype enhancements, major dimension ratios are preferably held within the range of 1:18 to 1:4. Particular attention must be given to braze metal content and distribution in this embodiment because base metal particles are individually bonded to the substrate and do not rely upon bonds with adjacent particles for structural support.

Examples of suitable braze metal powders are copper alloy containing 8 percent phosphorous, nickel alloy containing 11 percent phosphorous, nickel alloy containing 13 percent chromium and 10 percent phosphorous, and aluminum alloy containing 12 percent silicon. It is to be understood that the selection of the braze metal powder must be compatible with the base metal powder and with the substrate so as to produce a structurally sound metallic bond therewith.

The adherent mass produced in the first mixing step is combined with the braze metal powder in a second mixing step to produce a braze metal-coated mass. The interbonding of the two components is in weight proportion such that the brazed metal powder is between 10 and 30 percent of the braze metal powder plus the base metal powder. Strong bonds are usually produced when this ratio of components is held. Ratios lower than 10 may result in locally inadequate brazing of particles to the substrate or to adjacent particles. Ratios greater than 30 percent may result in an excessive amount of base metal particles and substrate being melted and dissolved into the molten alloy. This is undesirable because it may adversely affect the size and spacing of base metal particles and in weakening the substrate wall. In preferred practice, the weight proportion of braze metal is between 15 and 25 percent.

Admixture of the braze metal powder with the adherent mass produces a relatively dry, flowable powder-like material without appreciable tendency to agglomerate or to adhere to a container wall. The typical individual braze metal-coated mass consists of a large base metal particle with numerous small braze metal particles bonded to its surface. In effect the inter-particle attraction which characterized the adherent mass is essentially lost or destroyed by attachment of the braze metal particles to the base metal particles.

It is somewhat surprising that the small, braze metal particles will remain firmly attached to the large base metal particles despite attrition due to normal handling procedures such as stirring, pouring and agitating. Small particles possess an inherent tendency to agglomerate or cluster together and this tendency would seemingly be aggravated by mixing the powders in the presence of a liquid binder. Fortuitously, such agglomeration of the smallparticle constituent does not occur to any significant extent. If clustering or agglomeration of the braze-metal powder occurred, then the braze-metal component would be inadequately distributed among the base metal particles and the bonds between base metal particles and substrate would be weak and easily broken. Moreover, cluster of braze metal powder would produce local excessive concentrations of low-melting alloy thereby causing local excessive fusion of the base metal particles and of the substrate. Collapse of the base metal particles by excessive fusion will seriously impair heat transfer performance of the device, and excessive fusion of the substrate can cause weakening or penetration of walls which separate fluids undergoing heat exchange.

The braze metal-coated mass produced in the second mixing step may be partially rigidized to prevent the possible stripping and segregation of braze metal powder particles from the adherent mass during subsequent steps of the method. Where the first liquid binder contains higher volatility solvent such as kerosene, partial rigidizing may comprise heating the braze metal-coated mass at a relatively low temperature to volatilize solvent, thus increasing the plastic toughness of the first liquid binder in the braze metal-coated mass. Heating may be accomplished in a forced air oven at temperatures of 150°–200° F for several hours to partially rigidize the braze metal-coated mass. Partially rigidizing at higher temperatures should only be conducted under inert gas atmosphere (e.g., nitrogen or argon) to prevent undesirable oxidative attack on the braze metal-coated mass.

Where the first liquid binder contains a lower molecular weight, organic compound capable of cross-linking or polymerizing to higher molecular weight forms, "partial rigidizing" consists of imposing the conditions, thermal and/or catalytic required to produce the higher molecular weight forms. Alternatively, the first liquid binder may contain a thermoplastic organic compound whereby the braze metal-coated mass is formed at elevated temperature such that the binder is relatively fluid, and partial rigidizing is accomplished by cooling the braze metal-coated mass to room temperature.

Although a separate partial-rigidizing step is shown in the drawing, it should be understood that a discrete, separate step for such purpose is not always required. For some combinations of components and proportions thereof, adequate bond strength between braze metal powder and base metal powder can be obtained in the second mixing step. Such partial-rigidizing has been obtained for example using a first liquid binder consisting of 50 percent isobutylene polymer in kerosene which is applied to the base metal powder in a weight ratio of about 25:1 powder-to-binder. The resultant adherent mass is mixed with sufficient braze metal powder to provide 20 percent of the latter component in the total metal of the mixture. The braze metal-coated mass obtained directly in this manner has the desired dry, powder-like consistency with firmly bonded braze metal particles.

A metal substrate is now prepared to receive the braze metal-coated mass for metal bonding thereto. The substrate may be any form or shape suited to the specific heat exchange to be effected, e.g., flat plates or tubes. A preferred substrate is a tubular element and the braze metal-coated mass may be applied to either interior or exterior surfaces thereof. The substrate surface which is to receive the braze metal-coated mass is preferably cleaned to remove rust, scale and grease. Suitable substrate materials include copper, copper-iron alloy (e.g., containing 1–2 percent Fe), copper-nickel alloy (e.g., containing 5–30 percent nickel), steel, 3.5–9 percent nickel steel, stainless steel (e.g., types 304 and 316) and aluminum.

A second liquid binder is provided for coating the substrate. The second liquid binder may be similar to the first liquid binder. It should freely wet the substrate and should provide adherence for the braze metal-coated mass. It should flow or "level" itself when applied to give a uniform substrate coating. It should be removable from the substrate and braze metal-coated mass without leaving a residue detrimental to bonding or preformance.

The "binder application" step whereby the second liquid binder is coated on the substrate may be accomplished by any of several methods — the selection usually being influenced by the form and shape of the surface to be coated. Dipping may be used for surfaces which drain freely. Brushing or rolling is advantageous for readily accessible, exterior surfaces. Spraying is preferred for relatively inaccessible surfaces such as tubular interior surfaces.

If desired, the second liquid binder coated substrate may be further treated to thicken the deposited binder, thereby to render the coating more viscous and "tacky". This may be accomplished for example by vaporizing some of a high volatile component of the binder.

In the method step of the drawing labeled "application to substrate", the braze metal-coated mass is applied to the second liquid binder coated substrate in a manner to produce the desired structure of metal bodies on the substrate surface.

The form, consistency and quantity of the second liquid binder on the substrate surface at the moment the braze metal-coated mass is applied thereto is important because it determines whether a single or a multiple layer of braze metal-coated mass will be retained by and secured on the substrate surface. If the second liquid binderis non-viscous and "watery" and is present in a relatively thick layer on the substrate surface, then multiple layers of braze metal-coated mass will be applied. The multiple layer attachment will occur as a result of capillary action whic fully saturates a previously attached layer to the extent that it subsequently captures another layer superimposed thereon. This is a mechanism by which the multiple, stacked layers of braze metal-coated mass may be formed to produce the Milton-type surface for enhanced boiling heat transfer.

If the second liquid binder is non-viscous and "watery" and is present in an appropriately thin layer on the substrate surface, then there will be insufficient liquid binder to saturate the first layer of braze metal-coated mass and further layers will not be effectively captured. This is a mechanism by which the single layer Notaro-type surface may be formed for enhanced condensing heat transfer. The thinness of the binder tends to associate this mechanism with production of enhanced surface on the inside wall of tubular substrates.

If the second liquid binder is rendered quite viscous and tacky after its application on the substrate surface, to the point that it will not be drawn by capillary action over the surface of the braze metal-coated mass, then a first layer of braze metal-coated mass will not be capable of capturing another superimposed layer. This is an alternative mechanism for producing the abovementioned Notaro-type single layer surface.

The braze metal-coated mass may be applied to the binder coated substrate using one of several procedures, such as spraying, sprinkling or showering, or by passing the coated substrate through a fluidized bed of the braze metal-coated mass. The desity (mass quantity per unit substrate area) can be controlled when desired by metering the rate of spraying or showering, or by adjusting the residence time of the substrate surface in the application zone.

After applying the braze metal-coated mass on the substrate surface, the substrate is heated in a brazing step to a temperature sufficiently high to volatilize the first and second binders, to melt the braze metal and to metal bond the base metal to the metal substrate. The temperature should be below the melting points of both substrate and base metal. This may be accomplished in a controlled temperature furnace preferably with provision for maintaining an inert or reducing atmosphere in the high temperature zone. The substrate is then withdrawn from the brazing step and cooled. The resultant product is an enhanced heat transfer device consisting of a metal substrate and randomly distributed metal bodies bonded to the substrate.

Many combinations of base metal powder, braze metal powder and metal substrate may be employed usefully and effectively in the practice of the invention. Table I lists several such combinations by way of illustration.

TABLE I

| Base Metal Powder | | Braze Metal Powder | | Metal Substrate |
|---|---|---|---|---|
| Copper<br>Copper + 5–30% nickel | with either | Copper + 8% phosphorous<br>Nickel + 11% phosphorous | with either | Copper<br>Copper + 1–2% Iron<br>Copper + 5–30% nickel |
| Steel<br>Copper | with either | Nickel + 11% phosphorous<br>Nickel + 10% phosphorous + 13% chromium | with either | Carbon steel<br>Low alloy steel 3.5–9% nickel |
| Steel<br>Stainless Steel Types 304 or 316 | with either | Nickel + 11% phosphorous<br>Nickel + 10% phosphorous + 13% chromium | with either | Stainless Steel Types 304 or 316 |
| Aluminum | | Aluminum + | | Aluminum |

TABLE I-continued

| Base Metal Powder | Braze Metal Powder | Metal Substrate |
|---|---|---|
| | 12% silicon | |

One combination of the foregoing table which is particularly useful is a copper bearing base metal powder, a phosphorous-nickel braze metal powder and a copper bearing metal substrate.

The invention will be more fully understood by the following three examples in which different types of enhanced heat transfer devices were manufactured by first preparing the braze metal-coated mass.

EXAMPLE 1

A single layer of randomly distributed metal bodies was bonded to the inner wall of a tubular substrate. This single layer surface was prepared by first screening copper powder to obtain a graded cut, i.e., through 50 and retained on 60 U.S. Standard mesh screen from a commercially available copper powder, AMAX "O" (trade name American Metals Climax, Inc.). A portion of this graded cut weighing 2070 grams was placed into a large evaporating dish and subsequently slurried with 285 grams of a 6 percent by weight isobutylene polymer (Vistanex LM-MS), 6 percent kerosene and 88 percent benzene solution. After thorough mixing, sufficient of the benzene was evaporated on a hot plate to result in an adherent mass of copper particles and first liquid binder.

Phos-copper brazing alloy of 92 percent copper 8 percent phosphorous by weight weighing 517 grams which had been screened from phos-copper powder 1501 (New Jersey Zinc Company grade designation) to remove all particles larger than 325 mesh (U.S. Standard series sieves) was added to the adherent mass of copper base particles to formulate a ratio of 4 parts by weight copper to 1 part phos-copper. Thus, the major dimension ratio of braze metal powder to base metal powder was about 1:7. This is based on a base metal powder dimension of 0.0117 inch corresponding to No. 50 U.S. Standard mesh screen opening, and a braze metal powder dimension of 0.0017 inch corresponding to No. 325 U.S. Standard screen opening. After thorough blending, the resultant dry mix of phos-coper coated copper base metal particles was allowed to stand at ambient temperature overnight. So treated, the particles of phos-copper brazing alloy were evenly disposed on and secured by the polyisobutylene coating to the surface of the copper particles. The powder was dry to the touch and free flowing.

A CDA-192 (Copper Development Association designation 192) copper alloy tube with a 0.679-inch I.D. and a 0.735-inch O.D. was coated with second liquid binder composed of 30 percent polyisobutylene in kerosene by filling the tube with the binder followed by draining same from the tube to leave a thin adherent internal film of the binder on the internal tube wall. Next, the phos-copper coated copper base metal powder particles were poured through the tube thereby coating the internal tube surface substrate with a uniformly spaced single layer of braze metal-coated mass.

The external surface of the tube also was coated with a multiple layer of stacked copper particles integrally bonded together to form interconnected pores of capillary size in manner described in U.S. Pat. No. 3,384,154 to R. R. Milton (porous boiling layer). The tube was then furnaced at 1600° F for 15 minutes in an atmosphere of disassociated ammonia, cooled and then tested for heat transfer characteristics as an enhanced heat transfer device.

The sensible heat transfer enhancement of the aforedescribed test device was determined by boiling Refrigerant 12 (dichlorodifluoromethane) at 48 PSIA on the exterior tube surface and by flowing water at higher temperature at 9 ft/sec. through the internal surface covered with the single layer of bonded randomly distributed bodies. The boiling side heat transfer coefficient was already known, having been determined on a separate but similar boiling surface under the same conditions. The data of the instant test was reduced by extracting the known boiling side heat transfer resistance and the wall resistance in order to determine by difference the water side sensible heat transfer coefficient. The sensible heat transfer coefficient was found to be 2.55 times higher than obtained on a smooth surface metal substrate.

It should be noted that the use of an extremely volatile component of the binder such as benzene poses control problems which can usually be avoided by employing solvents of lesser volatility such as kerosene. In this example, the high volatility of the benzene makes it difficult to monitor and control the quantity of liquid binder remaining in the adherent mass during evaporation of a portion of the benzene. Moreover, continued vaporization of benzene occurs during addition and mixing of the braze metal powder and during application of the braze metal-coated mass to the substrate. Unless special precautions are taken to limit such continued evaporation, then loss of some braze metal from the base metal may occur before brazing can be completed. Special precautions designed to limit continued evaporation and to maintain residual first liquid binder within the ratios 20:1 and 30:1 base metal powder to first liquid binder, may include chilling the adherent mass and the braze metal-coated mass, and handling the adherent mass and the braze metal-coated mass in an atmosphere with high content of benzene vapor.

A lower cost and less complex way to handle the above problem is, as stated previously, to substitute a solvent of lesser volatility, e.g., kerosene, for all or a portion of the highly volatile solvent, e.g., benzene. The preferred solvents should exhibit low vapor pressure at room temperature such that the content of residual binder in the adherent mass and in the braze metal-coated mass does not change appreciably during the specific procedures and periods of time employed in the practice of the method. Use of such preferred solvent is illustrated in Example II.

EXAMPLE II

A single layer of randomly distributed metal bodies was bonded to the outer wall of a tubular metal substrate with the individual metal bodies spaced from each other and substantially surrounded by the metal substrate. This single layer surface was prepared by first screening copper powder to obtain a graded cut, i.e., through 30 and retained on a 40 mesh U.S. Standard screen using a commercially available copper powder, AMAX "0" (trade name). A portion of the graded cut weighing 300 grams was placed in an evaporating dish and subsequently blended with 15 grams of a 50 percent by weight isobutylene polymer (Vistanex LM-MS, trade name) 50 percent kerosene mixture. Thorough mixing gave an adherent mass of base copper particles and first liquid binder in the weight ratio, base metal to binder, of 20:1.

Phos-copper brazing alloy powder of 92 percent copper-8 percent phosphorous by weight, weighing 150 grams which had been screened from phos-copper powder 1501 (New Jersey Zinc Company trade designation) to remove all particles larger than 325 mesh (U.S. Standard series sieves), was added to the adherent mass of base copper particles and thorougly blended to give a dry free flowing mass. The admixture provided a major dimension ratio, braze metal particles to base metal particles, of about 1:35 based on a base metal particle dimension of 0.023 inch corresponding to 30 mesh U.S. Standard screen, and on a braze metal particle dimension of 0.0017 inch corresponding to 325 mesh U.S. Standard screen. This braze metal-coated mass was partially rigidized by heating in a forced air oven at 180° F overnight. After cooling, the braze metal-coated mass was screened on an 80 mesh U.S. Standard series sieve to remove the excess smaller phos-copper braze metal powder. A total of 73 grams of excess braze metal powder was removed, giving an almost exact ratio of 4 parts by weight base copper powder to 1 part phos-copper powder in the braze metal-coated mass. So treated, the particles of phos-copper braze metal powder were evenly disposed on and secured by the remaining first liquid binder to the surface of the base copper particles.

A pure copper OFHC (Oxygen-Free, High Condicutivity) copper tube with a 0.656 inch I.D. and a 1.125 inch O.D. was coated with a second liquid binder composed of 33 percent by weight polyisobutylene, 33 percent kerosene and 33 percent toluene. This binder was painted on the outer wall of the tube to obtain a thin uniform film. After several minutes of drying at ambient temperature to remove toluene, the aforementioned braze metal-coated mass was sprinkled on the tube outer surface to obtain a uniformly spaced single layer of the braze metal-coated mass. The tube was furnaced at 1600° F for 15 minutes in an atmosphere of dissociated ammonia, cooled, and then tested for heat transfer characteristics as an enhanced heat transfer device.

The condensation heat transfer enhancement of the aforedescribed test device was determined by condensing Refrigerant 114 (dichlorotetrafluoroethane) vapor on the exterior tube surface. The tube was vertically oriented, and was cooled by boiling R-114 on the tube interior at lower pressure. Heat input to the R-114 boiler was varied, and the tube wall temperature and condensing temperature difference measured at steady state conditions. The experimentally determined condensing temperature differences for this enhanced heat transfer device compared to that predicted by Nusselt are shown in the following Table II:

TABLE II

| Q/A BTU/hr,ft$^2$ | Vapor Composition | Measured ΔT ° F | Nusselt ΔT ° F |
|---|---|---|---|
| 6,000 | R-114 Refrigerant | 11.0 | 54.0 |
| 5,000 | " | 8.4 | 42.0 |
| 4,000 | " | 6.2 | 26.0 |
| 3,000 | " | 4.1 | 21.0 |

The condensing heat transfer coefficient is obtained by dividing the heat flux of column 1 by the ΔT of column 3 or 4. It is evident that condensing heat transfer was enhanced by a factor of about 5 over the Nusselt prediction for a smooth tube.

It should be noted that the same first liquid binder described in Example II and the same technique for producing the braze metal-coated mass can be employed with equal facility and advantage for producing the internal enhanced heat transfer surface of Example I.

EXAMPLE III

A multiple layer of randomly distributed metal bodies of the porous layer type of Milton U.S. Pat. No. 3,384,154 was bonded to the upper flat surface of a disk shaped pool boiling test specimen. This multiple layer surface was prepared by first screening copper powder into two graded cuts from a commercially available copper powder, C-135 (U.S. Bronze Powders, Inc. trade name). One graded cut was all the material retained on a 7 mesh U.S. Standard series sieve, the other cut was through 16 and retained on 20 mesh. Equal portions of these 2 cuts were blended in an evaporating dish and subsequently slurried with sufficient dilute isobutylene polymer (Vistanex LM-MS) dissolved in toluene (about 6 weight percent Vistanex) to completely flood the base metal powder. The toluene was evaporated at ambient temperature resulting in an adherent mass possessing free flowing characteristics. The flooding-evaporating procedure insures thorough wetting of the base metal particles, and by using appropriate quantity and dilution, the first liquid binder remaining in the adherent mass can be controlled within the desired ratio range, base metal to binder of 20:1 to 30:1.

Phos-copper braze alloy powder of 92 percent copper-8 percent phosphorous by weight which had been screened from C-302 phos-copper (grade designation U.S. Bronze Powders, Inc.) to remove all particles larger than 400 mesh (U.S. Standard series sieves) was added at a calculated amount to the adherent mass of copper base particles to formulate a ratio of 4 parts by weight base copper powder to 1 part phos-copper powder in the braze metal-coated mass. So treated, the particles of phos-copper braze metal powder were evenly disposed on and secured by the remaining first liquid binder to the surface of the base copper particles.

An OFHC coper disk specimen approximately 2.625 inches in diameter and 0.25 inches thick was coated on the upper flat surface with a second liquid binder composed of 30 percent by weight polyisobutylene 70 percent kerosene.

The binder was painted on the upper surface to give a uniform film. Next, the aforementioned braze metal-coated mass was applied onto the second binder coated surface to give a multiple layer of braze metal-coated mass 3–4 particles thick. The disk test specimen was heated to 1600° F in a pure hydrogen atmosphere and then rapidly cooled to room temperature. A strongly bonded, very coarse porous metallic matrix was obtained. It was tested for boiling heat transfer characteristics in very high vacuum, water-boiling media.

The boiling heat transfer enhancement of the aforedescribed test device was determined by boiling water at 0.1 PSIA in a pool boiling test apparatus. Heat was applied electrically to the bottom surface of the test device, the wall surface temperature measured and the boiling temperature difference was determined over a range of heat fluxes at steady state conditions. The boiling heat transfer coefficients for this enhanced heat transfer device at a heat flux of 40,000 BTU/(hr × ft²) was 1800 BTU/(hr × ft² × °F) and was 1.6 times higher than that observed under similar conditions with a smooth copper surface.

The major dimension of the base metal powder employed in the foregoing Example III may be determined as the weighted average of the two graded cuts which were blended together. Thus, the dimension of the 7 mesh graded cut is taken as 0.111 inch and that of the through-16 mesh graded cut as 0.047 inch. Since equal parts of the two graded cuts were used in the mixture, the arithmetic average major dimension is 0.079 inch. The ratio of major dimensions, braze metal powder to base metal powder, is 1:56, based on a braze metal particle dimension of 0.0014 inch corresponding to a 400 mesh screen.

It should be noted that a large fraction of the Example III base metal powder (50 percent) was of such major dimension (0.111 inch) as to produce a dimension ratio with the braze metal powder of 1:79 if considered separately. Blending these large particles with smaller (16 mesh) particles resulted in an average dimension ratio for mixture which was substantially greater, i.e., 1:56. This procedure produced satisfactory strength in the multiple layered porous boiling layer of Example III, probably because the large particles of base metal were secured into the structure by being metal bonded with several adjacent base metal particles. In effect, there exists a interparticle sharing of braze metal, and this offsets any deficiency in braze metal which otherwise might exist for large, isolated base metal particles secured only to the substrate surface. In the case of the single layered, Notaro-type surfaces of Examples I and II, such small dimension ratios are not advisable because each discrete braze metal-coated mass should ideally contain requisite braze metal component to independently secure the metal body to the substrate surface.

Although preferred embodiments of the invention have been described in detail, it will be understood by those skilled in the heat transfer device manufacture art that certain features may be practiced without others and that modifications are contemplated, all within the scope of the claims.

WHAT IS CLAIMED IS:

1. A method for manufacturing an enhanced heat transfer device consisting of a metal substrate and randomly distributed metal bodies bonded to said substrate comprising the steps of:

(a) providing base metal powder with particles of major dimensions less than 0.1 inch;

(b) mixing said base metal powder with first liquid binder and in proportion such that the weight ratio of base metal powder to first liquid binder is between 20:1 and 30:1, so as to form an adherent mass;

(c) providing braze metal powder having a melting point lower than said base metal powder and with particles of major dimensions such that the major dimension ratio of braze metal powder to base metal powder is between 1:60 and 1:3, and mixing said braze metal powder and said adherent mass in weight proportion such that said braze metal powder is between 10 and 30 percent of the braze metal powder plus the base metal powder, so as to form braze metal-coated mass;

(d) applying a second liquid binder on said metal substrate;

(e) applying said braze metal-coated mass on the second liquid binder coated metal substrate; and (f) heating the braze metal coated mass-metal substrate sufficiently to remove said first and second binders, melt said braze metal and metal bond said base metal to said metal substrate thereby forming said metal bodies.

2. A method according to claim 1 wherein said braze metal-weighted mass is applied as a single layer in step (e), and metal bodies of step (f) are spaced from each other and substantially surrounded by said metal substrate.

3. A method according to claim 2 wherein the particles of said base metal powder have major dimensions between 0.006 and 0.060 inch.

4. A method according to claim 1 wherein said first liquid binder is a mixture of isobutylene polymer and kerosene.

5. A method according to claim 2 wherein said braze metal powder and base metal powder have particles of major dimensions such that the major dimension ratio of braze metal powder to base metal powder is between 1:18 and 1:4.

6. A method according to claim 1 wherein said braze metal powder and said adherent mass are mixed in weight proportion such that said braze metal powder is between 15 and 25 percent of the braze metal powder plus the base metal powder.

7. A method according to claim 1 wherein said braze metal-coated mass is partially rigidized prior to the step (e) application on said second liquid binder-coated substrate.

8. A method according to claim 7 wherein the partial rigidizing is by heating.

9. A method according to claim 1 wherein said braze metal-coated mass is applied as a multiple layer in step (e), and the metal bodies of step (f) are stacked on each other and a porous layer is formed therefrom by step (f) in which the base metal particles are integrally bonded together and to the substrate to form interconnected pores of capillary size.

10. A method according to claim 2 wherein said second liquid binder contains a low volatiltiy component and a high volatility component, and said high volatility component is partially vaporized and removed from said metal substrate following step (d) and prior to step (e).

11. A method for manufacturing an enhanced heat transfer device consisting of a metal substrate and randomly distributed metal bodies individually bonded to said substrate in a single layer and spaced from each other and substantially surrounded by said substrate comprising the steps of:

(a) providing base metal powder with particles of major dimensions between 0.006 and 0.060 inch;

(b) mixing said base metal powder with first liquid binder comprising a low volatility, high molecular weight organic polymer component and a high volatiltiy solvent component, and in proportion such that the weight ratio of base metal powder to first liquid binder is between 20:1 and 30:1, so as to form an adherent mass;

(c) providing braze metal powder having a melting point lower than said base metal powder and with particles of major dimensions such that the major dimension ratio of braze metal powder to base metal powder is between 1:30 and 1:3 and mixing said braze metal powder and said adherent mass in weight proportion such that said braze metal power is between 15 and 25 percent of the braze metal powder plus the base metal powder, so as to form braze metal-coated mass;

(d) applying a second liquid binder comprising a low volatility, high molecular weight organic polymer component and a high volatility solvent compound on said metal substrate;

(e) applying said braze metal-coated mass on the second liquid binder coated metal substrate; and (f) heating the braze metal-coated mass-metal substrate sufficiently to completely remove said first and second binders, melt said braze metal and metal bond said base metal to said metal substrate thereby forming said metal bodies.

12. A method according to claim 11 wherein said metal bodies comprise a mixture of copper as the major component and phosphorous as a minor component.

13. A method according to claim 11 wherein said metal bodies comprise a mixture of iron as the major component and phosphorous and nickel as minor components.

* * * * *

UNITED STATES PATENT OFFICE

CERTIFICATE OF CORRECTION

Patent No. 4,101,691 Dated July 18, 1978

Inventor(s) Robert C. Borchert

It is certified that error appears in the above-identified patent and that said Letters Patent are hereby corrected as shown below:

Column 15, line 2, "power" should be -- powder --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*